United States Patent [19]

Oeschger

[11] 4,027,277

[45] May 31, 1977

[54] VACUUM RELAY WITH REDUCED SENSITIVITY TO MANUFACTURING TOLERANCES AND OPTIONAL LATCHING FEATURE

[75] Inventor: Joseph E. Oeschger, Palo Alto, Calif.

[73] Assignee: International Telephone and Telegraph Corporation, New York, N.Y.

[22] Filed: July 14, 1975

[21] Appl. No.: 595,435

[52] U.S. Cl. ..... 335/151; 335/154

[51] Int. Cl.[2] ..... H01H 1/66

[58] Field of Search ..... 335/151, 153, 154, 196, 335/235, 292; 200/61.62 T; 317/152

[56] References Cited

UNITED STATES PATENTS

| | | | |
|---|---|---|---|
| 3,258,559 | 6/1966 | DeLucia | 335/151 |
| 3,275,775 | 9/1966 | Hawkins | 335/154 |
| 3,295,023 | 12/1966 | Peras | 335/153 |
| 3,534,192 | 10/1970 | Miles | 335/151 X |

FOREIGN PATENTS OR APPLICATIONS

| | | | |
|---|---|---|---|
| 677,337 | 6/1939 | Germany | 335/151 |

*Primary Examiner*—George Harris
*Assistant Examiner*—Fred E. Bell
*Attorney, Agent, or Firm*—William T. O'Neil

[57] ABSTRACT

A hermetically sealed relay of the reed-type in which an elongated switching control rod is angularly displaced in operation. The extreme positions include internal stops, which may be contacts, in which case the switch is a single-pole-throw device. An attached actuator for the switch device provides tolerance-absorbing overtravel by means of uniquely arranged resilient means, such that switch-gap tolerances are effectively absorbed. The device may be of the magnetically latching type or may, in simplest form, include a single controlling electromagnet and only one fixed contact.

11 Claims, 5 Drawing Figures

VACUUM RELAY WITH REDUCED SENSITIVITY TO MANUFACTURING TOLERANCES AND OPTIONAL LATCHING FEATURE

BACKGROUND OF THE INVENTION

1. Field of the Invention

The present invention relates to hermetically sealed relays, and is adapted to vacuum or gas-filled relay technology with or without a latching capability.

2. Description of the Prior Art

Vacuum type and other sealed relays of the general class and performing the general functions provided by the combination of the present invention are known. U.S. Pat. No. 3,576,066 illustrates and describes such a relay as known in the prior art, with particular emphasis on processes useful in its manufacture.

Although devices of the general type are usually thought of as vacuum relays, they can be constructed as gas-filled switching devices, if desired.

Prior art devices of the type to which the present invention applies generally comprise two separately manufactured sub-assemblies prior to final assembly. One of these sub-assemblies is the hermetically sealed switch assembly itself, and the other is the actuator assembly. In the aforementioned U.S. Pat. No. 3,576,066, the first of these sub-assemblies is typically illustrated in FIG. 2, and the second in FIG. 5.

Although the present invention is not confined to the use of stacked ceramic cylinders forming the evacuated switch enclosure, that type of construction is well known in the prior art and affords significant manufacturing advantages vis-a-vis, blown-glass bulb enclosures or the like.

Prior art actuators of the required type have taken several basic functional forms, including those which provide latching in first and a second controlled positions by mechanical means and those providing magnetic hold in first or second positions to achieve a similar latching effect. These prior art actuator arrangements have usually involved lash or lost motion. Inherently, such actuators have also operated against discrete internal limits, i.e., against their own internal stops, and it therefore has been necessary to very carefully control the switch gap in the mating vacuum switch part so that the switch contacts in one or both directions will be effected with some residual force. Once the vacuum switch enclosure is fully assembled and sealed, it is not possible from a practical point of view to adjust the switch gap (i.e., the spacing between the two switch positions), and if the actuator does not provide an appropriate "overtravel" to absorb at least a portion of the switch contacts at the alternate positions, the manufacturing reject rate is likely to be high and the life of the assembly and vacuum brazing tools and fixtures quite limited.

In the prior art actuators of the type, the overall performance characteristics cannot be appropriately evaluated or production tested until after final assembly to the vacuum switch housing. Therefore, previously undetected dirt or foreign matter in the actuator may cause its rejection along with that of the switch enclosure, since the prior art actuators are not readily opened for cleaning or inspection.

Where the actuator operates against a definite stop within itself in each of two positions, any effort to relieve its own tolerance problems can result in loose parts. The same may be said of the switch assembly, per se.

Thus, the prior art arrangements in which both the switch assembly and the driving actuator operate against their own definite internal stops gives rise to manufacturing problems, particularly in respect to tolerances.

The manner in which the present invention deals with the problems of the prior art to produce a novel and improved overall device will be evident as the description proceeds.

SUMMARY OF THE INVENTION

In accordance with the disadvantages and problems of the prior art it may be said to have been the general objective of the present invention to produce a hermetically sealed relay of the type described, which may be constructed as a simple electromagnetically controlled switch of simple form, or as a latching relay, in an arrangement which is relatively insensitive to manufacturing tolerances, including those induced by tooling wear, and the normal tolerances of the component parts themselves.

The invention applies typically to the type of hermetically sealed relay constructed from a plurality of stacked hollow cylindrical sleeve sections of insulating material (most commonly of ceramic material). This assembly of insulating sleeve sections forms an elongated enclosure or housing. The sleeve sections are furnace brazed (preferably in a vacuum), the end surface annulus of each such sleeve section having been prepared for sealing according to a well-known procedure in this art. The electrical terminal structure is integrally sealed between the sleeve sections, that terminal structure also providing the support means for the internal contacts. One end of the enclosure is capped in the process and other is sealed by means of a flexible conductive diaphragm member, through the center of which a switching control rod or rod member generally axially extends within the sealed housing and for a small distance outside the diaphragm. That portion of the overall structure generally comprises the sealed switch assembly, and is manufactured independently of the actuator.

The bars which comprise the fixed contacts, also provide fixed stops against which the switching rod member rests in each of the two discrete angular positions thereof.

The separately manufactured actuator is capable of angularly controlling the external end of the said switch rod member when mated to the sealed switch assembly. Within the actuator, a clapper is drawn to a pole piece in response to energization of a cooperating electromagnet, the clapper is formed of magnetic flux transmissive material as is the pole piece and a housing surrounding the coils and pole piece. The pole piece is generally axially disposed along the centerline of the actuator device, which is substantially also the centerline of the switch enclosure, when these are mated together in final assembly. When the electromagnet is de-energized, a spring pushes against a relatively rigid portion of a mechanical linkage extending generally axially and normally from the surface of the clapper, to urge the clapper away from the pole piece, i.e., rotate it about pivot point along one edge of the said clapper.

The aforementioned rigid member, which is a portion of the mechanical linkage between the actuator proper and the switch rod member, extends and abuts laterally against the said rod member and serves to provide an "overtravel" or residual pressure tending to keep the switch rod member firmly in the corresponding angular position against the corresponding stop within the switch structure. An oppositely bearing relatively resilient leaf spring member also extends generally axially and normally to the clapper and bears on the opposite side of the switching control rod member. In the clapper position against the aforementioned pole piece, corresponding to energization of the electromagnet, this leaf spring will be slightly deflected, thereby providing the same type of residual pressure against the switch control rod member in the other angular position. In this way, the so called "switch gap " tolerance may be absorbed in each of the two switch positions.

The magnetic actuator itself, may include, in addition to the electromagnet, a second electromagnet and one or more permanent magnets contributing flux to the same magnetic circuit, i.e., through the center pole piece, through the clapper, and returning to the other side of the pole piece through the magnetic flux transmissive housing containing the actuator magnetic components as aforementioned.

The device may thereby be constructed as a "latching" relay, the permanent magnet flux being sufficient to hold the clapper seated against the pole piece against the first spring means force in the absence of energizing of either of the electromagnets. The permanent magnet field intensity is not sufficient however, to draw the clapper into position against the first spring means to the "clapper open position" corresponding to the other switch control rod member angular position. One of the two electromagnets is designed to provide sufficient augmentation of the permanent magnet field to draw the clapper against the pole piece. That electromagnet need only be momentarily energized, since the permanent magnet field thereafter holds the clapper in that "closed" position, as aforesaid. The other electromagnet provides a bucking field upon momentary excitation so as to cancel at least a sufficient portion of the permanent magnet field to permit the clapper to be restored to the "open" position by the first spring means. Thus, that particular variation of the basic combination of the present invention provides a latching relay.

It will be realized as this description proceeds that the relay in accordance with the present invention is basically most adapted for single pole, single throw (SPST), or single pole, double throw (SPDT) configurations.

Other improvements over the prior art will be noted as this description proceeds.

BRIEF DESCRIPTION OF THE DRAWNGS

DESCRIPTION OF THE PREFERRED EMBODIMENT

Figure 1:
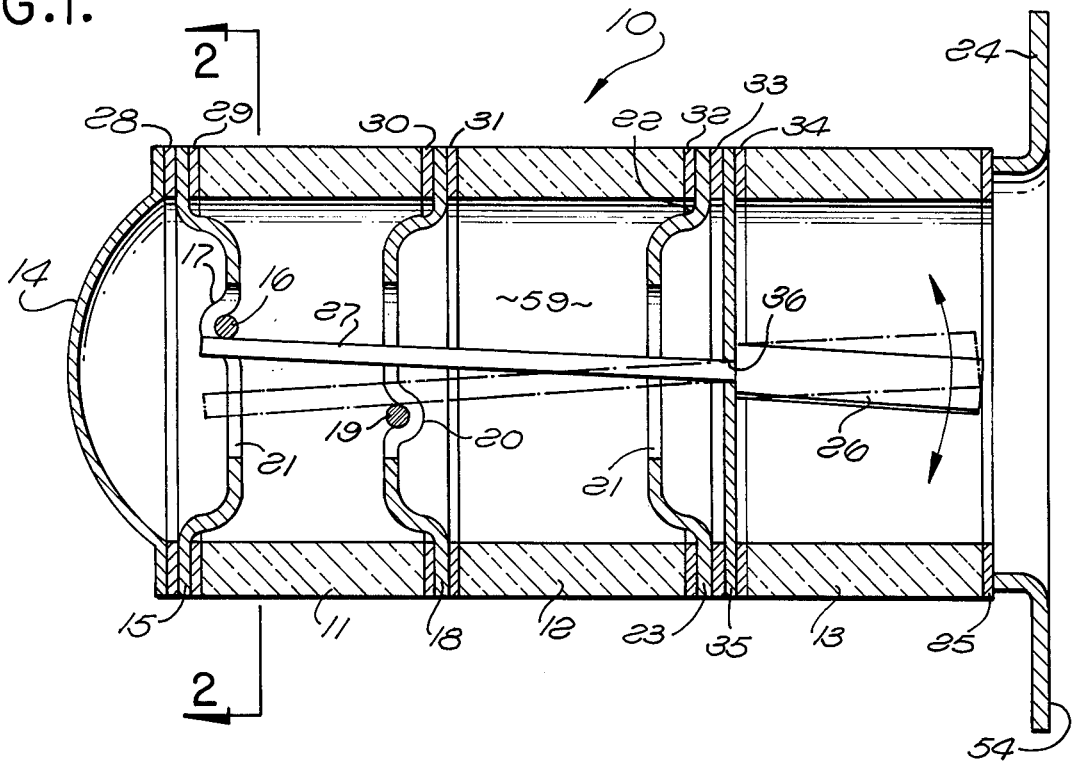
FIG. 1 is a sectional view of the sealed switch sub-assembly of a relay in accordance with the present invention.

Referring now to FIG. 1, the switch sub-assembly of a relay in accordance with the present invention will be described. The vacuum relay form of the invention will be described.

This swich sub-assembly is identified generally at 10, and comprises three of the hollow cylindrical shell ceramic body or housing members 11, 12 and 13, which form the insulating portions of the sealed enclosure. These ceramic hollow cylinder members may be joined either by hydrogen furnace brazing with subsequent defusion exhaustion of the hydrogen or in a vacuum furnace, the latter being preferred. To carry out the brazing process, the parts illustrated in FIG. 1 are assembled in a V-grooved jig composed of graphite or other material of similar characteristics. The V-groove may be tilted slightly so that the parts tend to be held together axially by gravity during the brazing process. End sealing is effected by the metallic cap 14 on one end and by the diaphragm 35 on the other end. Cupped flange parts 15, 18 and 23 having outside diameters substantially the same as that of the hollow cylindrical ceramic body parts are brazed to the prepared ends of these ceramic parts and in the case of the cap end, the cup flange 15 and end cap 14 are brazed together. As the parts illustrated on FIG. 1 are assembled into the brazing jig, annular discs ("washer-like" parts) of brazing material are inserted, particularly at 28, 29, 30, 31, 32, 33, 34 and 25. The flange part 24 is brazed to the ceramic part 13 thereby providing convenient means for connecting the actuator to the finished switch device.

A switching rod member 27 of a conductive material, which is relatively hard and possessed of known desirable electrical contact characteristics such as one of the refractory metals (i.e., titanium tungsten molybdenum or one of the alloys known for the purpose). At 36, this conductive rod 27 is affixed to an insulating sleeve 26 (preferably of a ceramic material similar to that of parts 11, 12 and 13), to provide an insulating mechanically controllable free end for switching control. At 36, the rod passes through a central aperture formed in the flexible diaghragm 35 and is hermetically brazed thereto. The flexibility of diaphragm 35 permits the angular displacement of rod 27 between the extremes or stops provided by contacts 16 and 19.

Figure 2:
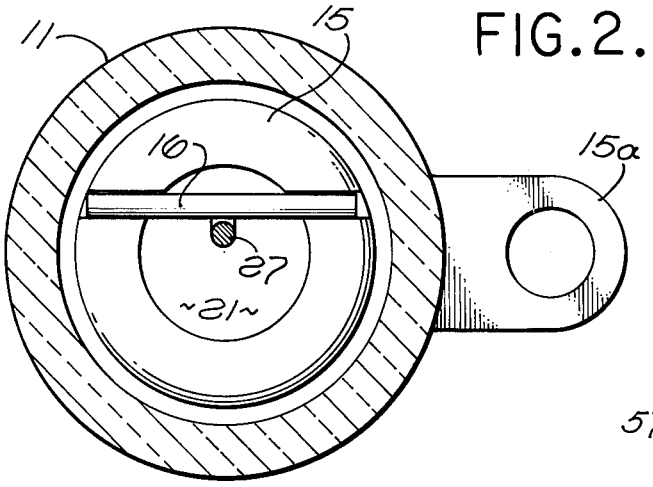
FIG. 2 is a sectional view taken orthogonally through FIG. 1 as indicated.

Referring also to FIG. 2 for clarity, it will be seen that these contact rods 16 and 19, which are ordinarily of the same material as rod 27, are brazed or welded in place in corresponding convolutions 17 and 20 in the respective cup flange parts 15 and 18, respectively. Each of the cup flange parts aforementioned has a central opening typically 21, through which rod member 27 passes.

The technical literature of the prior art, including U.S. Pat. No. 3,576,066 aforementioned, contains additional information regarding materials for the various parts of the switch sub-assembly 10. The end cup 14 would normally be of a metallic material, (such as nickel) permeable to hydrogen at high temperatures if the hydrogen atmosphere furnace brazing operation with subsequent diffusion processing to remove the hydrogen is employed. In the preferred vacuum brazing operation, however, there is no such requirement for the material of the end cap 14 and it may therefore be selected in accordance with environmental performance requirements and suitability for withstanding the temperatures of the vacuum brazing operation, as a matter of design choice. Much the same design choice applies to the selection of the cup flange parts, typically 15 with its integral connection lug 15*a*.

In accordance with the foregoing, it will be noted that a single brazing operation effects the sealing and mechanical assembly and it emerges therefrom ready for assembly to the actuator device. The emplacement of the fixed contact rods 16 and 19 to the respective parts 15 and 18, as well as the hermetic sealing of the rod 27 to the diaphragm 35 at 36, are best accomplished prior to the vacuum furnace brazing operation by individual welding or brazing operations. The mechanical joint between 27 and 26 at the joint 36 is outside the evacuated interior of the switch assembly and there is no requirement for hermetic sealing at that point, the diaphragm 35 having already been sealed to 27. Brazing onto a prepared surface of 26 can be employed, however, a properly chosen industrial adhesive is capable of providing this function. In any event, the exposed end of 26 to the right of the diaphragm 35 as viewed on FIG. 1, provides the opportunity of installing the insulating sleeve part 26 after completion of the vacuum brazing step, the part 26 then mechanically becoming a part of the switch control rod.

Figure 3:
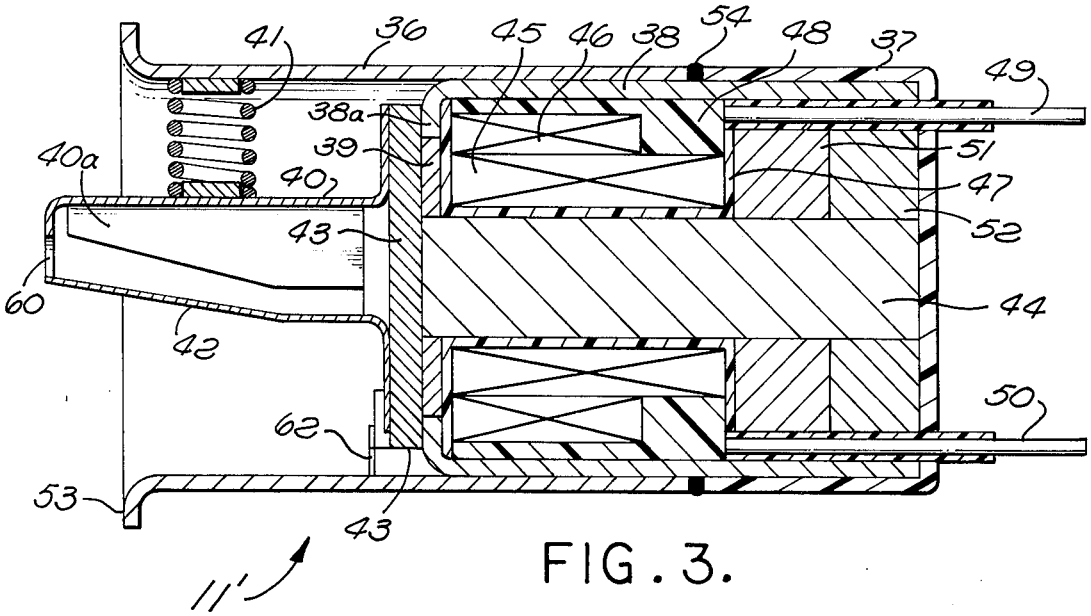
FIG. 3 is a sectional view of the actuator and mechanical linkage sub-assembly portions of the present invention.

Referring now to FIG. 3, the actuator with integral mechanical linkage for connecting it to the switch rod assembly at the right end (as depicted) of 26 is seen generally at 11. The discussion and explanation of FIG. 3 will be undertaken in connection with the end view, FIG. 4, for maximum clarity.

The actuator embodiment depicted in FIG. 3 is that involving two electromagnet coils 45 and 46 and a pair of permanent magnets 51 and 52, all of these being capable of contributing magnetic flux to essentially the same magnetic circuit, comprising the centerpole piece 44, clapper 43, the magnet housing 38 (including the inwardly turned lip 38*a*), and back through the permanent magnets 51 and 52 to the centerpole piece 44 to form a complete loop.

It should be understood that, although the actuator structure being described is the "latching" version, the invention is also applicable to the simplest format in a relay, namely, the single electromagnet non-latching version. In such a device, only a single electromagnet coil, for example 45, need be used and this might occupy the space devoted to 45 or 46 on FIG. 1. Also, the permanent magnets right beyond the magnet coil spool edge 47 would be replaced by a return magnetic circuit plate (not shown), bridging the pole piece right end to the open right end of housing 38 would be omitted in such a version.

The clapper 43 is illustrated in its "closed" position, i.e., drawn against the end of the pole piece 44, and the permanent magnets 51 and 52 are sufficiently strong to retain it in that position. The parts of the magnetic circuit, including the clapper 43, the magnet assembly housing 38 and the pole piece 44 are to be understood to be materials of relatively high magnetic flux transmission capability, but of low retentivity. The permanent magnets 51 and 52 are the exception to this however, in that they must also exhibit high retentivity, a characteristic well understood in connection with permanent magnets.

Let is be assumed that neither electromagnet coil 45 nor 46 is energized and, the clapper 43 being in the (closed) position illustrated, the actuator is controlling the switch sub-assembly into one of its two switch positions. A relatively rigid, or inflexible, mechanical linkage member 40 having side stiffening gussets 40*a* extends leftward (as seen on FIG. 3) essentially with its top surface parallel to the axial centerline of the actuator. The opening at the end, identified as 60, will be seen to be shifted upward with respect to the said axial centerline. Since the completed device involves the attachment of the flange 53 of the actuator shell 36 to the surface 54 of flange 24 (see FIG. 1), thus in the closed clapper position the right end of the switch rod sleeve 26 would be mechanically urged upwardly as seen on FIG. 1, and the rod 27 left of the diaphragm fulcrum point 36 would be correspondingly urged downward into contact with 19.

Figure 4:
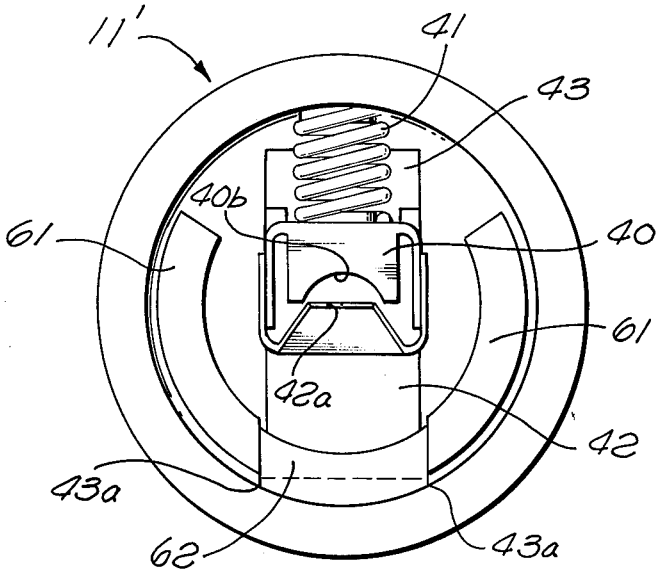
FIG. 4 is an end view of the actuator and mechanical linkage of FIG. 3

From FIGS. 3 and 4 it will be seen that leaf spring part 42 would be resiliently "down-sprung" in order to accommodate the circular cross-section of part 26. Depending upon the tolerance conditions all around , the part 26 might ride (in that situation) less than completely seated in the arcuate opening 40*b* at the top of the opening 60. Thus, there is residual mechanical force tending to keep the rod 27 in firm contact against contact 19, irrespective of nominal tolerance variations in the switch and acutator. The end lip 42*a* of the leaf spring 42 may also be made slightly concave as a design variation.

It will be understood that the compression spring 41 exerts a force against 40, tending to cause the clapper 43 to rotate "open" about the pivotal points 43*a*, however it is not a sufficiently great force to counteract the latching force exerted by the permanent magnets. If the smaller electromagnet coil 46 is momentarily energized in the bucking current direction (i.e., so as to create a flux opposing that of the permanent magnets) then the net magnetic retention force acting on the clapper 43 is reduced to the point where the spring 41 can operate to rotate the clapper about the said points 43*a*. In that event, the opening 60, which accommodates the rod sleeve 26 of the switch sub-assembly, is shifted downward as viewed on FIG. 3. The result is that the rod 27 changes to a position in contact with 16. In thatcase, the spring 41 exerts a residual force tending to hold it there and overcoming any tolerance build-up which might otherwise prevent positive switch contact pressure. This capability for "overtravel" of the mechanical linkage comprising the parts 40 and 42 basically, thus employs both the spring 41 and the resilient (leaf spring) member 42 to effect the aforementioned contact retention force in both switch positions.

Once the switching operation corresponding to clapper "open", clapper 43 has rotated about 43*a* away from the pole piece, and here the permanent magnet flux is not sufficient to pull the clapper 43 back against the pole piece 44 against the force of spring 41. It is, of course, well known, that as the gap in a magnetic circuit increases, a larger magnetomotive force is required to produce an equivalent flux, vis-a-vis, that required to produce the same flux in a minimum or zero gap situation.

If the larger electromagnet coil 45 is next momentarily energized so as to produce a sufficient magnetic force aiding that of the permanent magnet, the clapper 43 will be again drawn against the pole piece 44 and will remain there because of the retention force exhibited by the said permanent magnets around the aforesaid magnetic circuit, even though the electromagnetic coil 45 is only momentarily energized.

As illustrated on FIG. 3, the space 48 comprises a keeper of non-magnetic insulating material for preserving the magnet coil alignment illustrated. Electrical leads 49 and 50 are shown for the sake of completeness, these being only two of four required for the two electromagnet latching version illustrated, as will be later be seen more clearly in connection with FIG. 5.

A washer 39, of non-magnetic material, such as monel, may be brazed through its center hole over the end of the pole piece 44 to serve as a mechanical closure over the clapper end of the electromagnet assembly. It is necessary that this part be non-magnetic in order to avoid "short circuiting" the magnetic flux which it is desired to have pass through the clapper 43.

The more or less rectangular nominal shape of the clapper 43 may be observed from FIG. 4, however it will be realized that this shape is arbitrary and a matter of design choice only.

A keeper 61 of partial circular shape as illustrated in FIG. 4, has a raised portion 62 acting as a retainer for the clapper 43 by forming a pocket as seen from FIGS. 3 and 4. This expedient is more important as an assembly convenience than a functional necessity once the switch and actuator sub-assemblies are fully mated. This pocket formed by the raised portion of 61 at 62 is sufficiently loose to avoid binding of the clapper in the vicinity of the pivot points 43*a*. The keeper portion 61 may be readily attached, as by spot welding to the magnet assembly housing lip 38*a*.

The completed switch and actuator sub-assemblies 10 and 11, respectively, are very conveniently mated by first applying several spot welds through the actuator housing flange 53 and the switch sub-assembly flange 54. Thereafter, if required, heliarc welding, external brazing or the like, can be applied to environmentally seal the assembly, although only the interior of the switch sub-assembly between the end cap 14 and the diaphragm 35 (comprising the space 59) is normally hermetically sealed. An end-bell 37 joined by an adhesive seal 54, serves as a protective cover at the other actuator end and would normally be of non-magnetic material in the arrangement as illustrated in FIG. 3, although that is not a functional requirement.

Figure 5:
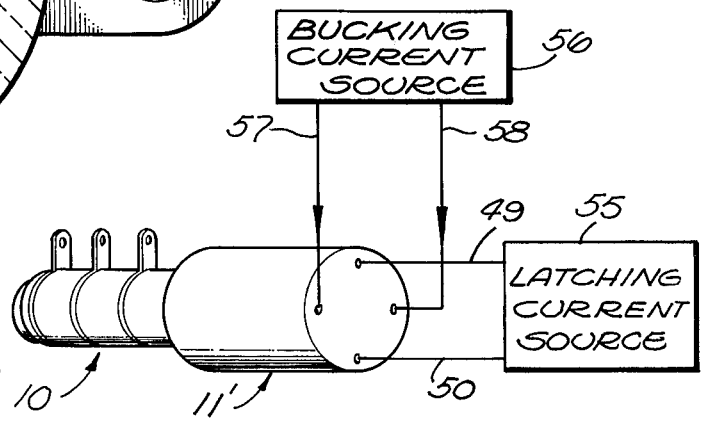
FIG. 5 is a block diagram showing a typical relay in the latching variation with sources of latching and bucking current.

Referring now to FIG. 5, a pictorial view of the typical assembly of switch sub-assembly 10 and actuator sub-assembly 11, is shown. In the embodiment depicted in FIG. 3, four leads, i.e., two for each of the magnet coils 45 and 46, are usually required, unless one leg of each coil is considered "common", in which case only three external leads need to be used.

It may be assumed that leads 49 and 50 from the source of latching current 55 lead to the larger coil 45, i.e., the electromagnet capable of drawing in the clapper 43 from its "open" position. Leads 57 and 58 are shown in FIG. 5 conducting current from a bucking current source 56 to the smaller coil 46, i.e., for producing the relatively small cancellation or bucking flux necessary to overcome the retentive effect of the permanent magnets in order to release clapper 43 from the "closed" position illustrated and allow spring 41 to rotate it and the parts of the aforementioned mechanical linkage about the pivot point 43*a*, as already described.

A number of variations will suggest themselves to those skilled in this art, once the concepts of the present invention are fully appreciated. Accordingly, it is not intended that the drawings or this description should be considered as limiting the scope of the invention, the said drawings and specification being typical and illustrative only.

Certain additional features of interest and practical importance should be pointed out to the skilled reader. For example, the cupped flange contact supports, such as 15, provide an inside baffling effect tending to reduce the tendency for corona to develop within the evacuated space. While it is known, for example, from the aforementioned U.S. Pat. No. 3,576,066, to cup the contact supports, an improvement in the structure of the present device has been effected by also cupping the part 23. Thus, the surface at point 22 tends to restrain the shape of the brazing material washer 32 during the furnace braze operation, to avoid the development of sharp points and irregularities which tend to give rise to internal corona, are prevented.

Further, prior art devices have frequently used a re-entrant type seal whereby the flange part 24 is joined to the outside circumference of ceramic part 13. In the present device, a so-called "cookie-cutter" seal is made between 13 and 24 and the need for a specially prepared ceramic part 13 is eliminated. Accordingly, the ceramic parts 11, 12 and 13 may be identical.

What is claimed is:

1. A relay comprising:

an axially elongated enclosure having a longitudinally extending axis and including at least one internally disposed fixed contact and a first external terminal conductively connected to said contact, said enclosure having a flexible conductive diaphragm at one end thereof;

a conductive switching rod member passing through said diaphragm generally normal to the plane thereof and being mechanically and electrically connected thereto, said rod member extending externally and also generally axially within said enclosure, said rod member providing switching action in cooperation with said fixed contact as a function of variation of the angular position of said rod member with respect to said axis of said enclosure;

an actuator device connected to the portion of said rod member external to said enclosure to control said angular position of said rod member to effect switching action between said rod member and said fixed contact;

means within said actuator including at least a first electromagnet, a clapper of magnetic material arranged to assume a predetermined magnetically induced first position in response to energization of said first electromagnet, a mechanical linkage arranged for transferring motion of said clapper to angular motion of said rod member substantially about the point of passage of said rod member through said diaphragm as a fulcrum;

first resilient means associated with said mechanical linkage for maintaining a residual resilient force retaining said rod member in a first position with respect to said fixed contact while said clapper is in said first magnetically induced position;

and second resilient means associated with said mechanical linkage for maintaining a residual resilient force retaining said rod member in a second position with respect to said fixed contact while said clapper is in a second position corresponding to deenergization of said electromagnet, said second resilient means also serving to separate said clapper from the pole piece of said electromagnet.

2. Apparatus according to claim 1 including at least one permanent magnet producing a magnetic field operative to hold said clapper in said first predetermined clapper position, the relative forces applied by said permanent magnet and said second resilient means being such that said clapper is not pulled into said first predetermined magnetically induced position except when said electromagnet is energized in a current direction producing a magnetic field aiding that of said permanent magnet for a time sufficient for said clapper to seat in said first predetermined position.

3. Apparatus according to claim 2 including a second electromagnet arranged to produce a magnetic field bucking the field of said permanent magnet when energized, in which said means are provided for energizing said first electromagnet to latch said relay in said first clapper position and to alternatively energize said second electromagnet to release said clapper and permit said second resilient means to cause it to assume said second clapper position.

4. Apparatus according to claim 2 including means for alternately energizing said electromagnet in a current direction to produce a magnetic field aiding that of said permanent magnet thereby to latch said relay, and for energizing said electromagnet in the opposite current direction to produce a magnetic field bucking of said permanent magnet, thereby unlatching said relay.

5. Apparatus according to claim 1 in which said rod member includes an insulating portion affixed to the conductive portion external of said diaphragm, said rigid member and said relatively flexible member bearing on said insulating portion, thereby to effect control of said rod member and provide electrical isolation of said rod member from said actuator.

6. Apparatus according to claim 4 including a magnetic flux transmissive housing at least partially surrounding said electromagnet and a generally axial and substantially centered pole piece as a part of said electromagnet, and in which said electromagnet flux and said permanent magnet fluxes pass through a magnetic circuit including said flux transmissive housing, said pole piece and said clapper.

7. Apparatus according to claim 1 in which said first portion of said rod is defined as being against said first contact, and in which a second external terminal connection to said diaphragm is provided, whereby electrical continuity is established between said first and second external terminals corresponding to said first rod position.

8. Apparatus according to claim 7 including a second fixed contact within said enclosure arranged such that said rod member is in electrical contact therewith in said second rod member position, and in which a third external terminal connected to said second fixed contact is provided, electrical continuity between said second and third terminals thereby being provided corresponding to said rod member second position.

9. Apparatus according to claim 1 in which said enclosure is further defined as hermetically sealed, said diaphragm being sealed to said rod member as well as being electrically and mechanically connected thereto.

10. Apparatus according to claim 8 in which said enclosure is further defined as hermetically sealed, said diaphragm being sealed to said rod member as well as being electrically and mechanically connected thereto.

11. Apparatus according to claim 1 in which said mechanical linkage comprises a relatvely rigid mechanical member extending from and affixed to said clapper, said rigid member laterally engaging said externally extending portion of said rod member, and in which said first resilient means associated with said mechanical linkage comprises a leaf spring member also extending from and affixed to said clapper, said leaf spring member laterally engaging said externally extending portion of said rod member substantially oppositely with respect to the lateral engagement of said rigid member, said leaf spring deflecting to provide said residual resilient force against said rod member when said clapper is in said magnetically induced first position.

* * * * *